US008221150B2

(12) United States Patent
Houir Alami

(10) Patent No.: US 8,221,150 B2
(45) Date of Patent: Jul. 17, 2012

(54) DEVICE FOR SECURE ELECTRICAL CONNECTION

(75) Inventor: Mounim Houir Alami, Paris (FR)

(73) Assignee: Societe d'Exploitation des Procedes Marechal, Saint-Maurice Cedex (FR)

( * ) Notice: Subject to any disclaimer, the term of this patent is extended or adjusted under 35 U.S.C. 154(b) by 0 days.

(21) Appl. No.: 13/001,227

(22) PCT Filed: May 19, 2009

(86) PCT No.: PCT/FR2009/000579
§ 371 (c)(1),
(2), (4) Date: Feb. 25, 2011

(87) PCT Pub. No.: WO2010/007221
PCT Pub. Date: Jan. 21, 2010

(65) Prior Publication Data

US 2011/0171849 A1 Jul. 14, 2011

(30) Foreign Application Priority Data

Jun. 25, 2008 (FR) ..... 08 03545

(51) Int. Cl.
*H01R 13/627* (2006.01)

(52) U.S. Cl. ..... 439/352; 439/372

(58) Field of Classification Search ..... 439/352, 439/372, 350, 353, 357, 358
See application file for complete search history.

(56) References Cited

U.S. PATENT DOCUMENTS 4,183,605 A 1/1980 Arneson
4,525,610 A 6/1985 Le Magourou
4,678,254 A * 7/1987 Le Magourou ..... 439/139
5,807,129 A * 9/1998 Konda et al. ..... 439/348
5,820,395 A * 10/1998 Hashizawa ..... 439/271
5,997,333 A * 12/1999 Konda et al. ..... 439/352
(Continued)

FOREIGN PATENT DOCUMENTS

EP 0 106 931 5/1984
(Continued)

OTHER PUBLICATIONS

English Version of PCT/ISA/210, Sep. 29, 2009.
(Continued)

*Primary Examiner* — Ross Gushi
(74) *Attorney, Agent, or Firm* — Greenblum & Bernstein, P.L.C.

(57) ABSTRACT

The invention relates to an electrical connection device formed of an active base (2) and a plug (1), pilot contacts of a pilot circuit being provided for controlling an apparatus by switching the same on or off, respectively, the power contacts of the base by means of an actuator (10) set up on the base while a device (11, 12; 14), for locking and unlocking the plug into the base in a connection position, is also provided. The device according to the invention is particularly remarkable in that a means (11; 12) for locking the base separately from the actuator (10) is movably mounted, the actuator (10) of the pilot circuit being set up to secure said base locking means in the locked position thereof when said pilot circuit is closed and release the locking means when the pilot circuit is open, while the base locking means prevents all operations for coupling the plug and the base, or for separating the latter once coupled, when said locking means is secured in the locked position thereof by said actuator (10).

20 Claims, 3 Drawing Sheets

U.S. PATENT DOCUMENTS

| | | | | |
|---|---|---|---|---|
| 6,056,577 | A * | 5/2000 | Blanchet | 439/352 |
| 6,123,569 | A * | 9/2000 | Fukushima et al. | 439/456 |
| 6,632,102 | B1 * | 10/2003 | Gherardini | 439/352 |
| 6,652,306 | B2 * | 11/2003 | Karamatsu et al. | 439/310 |
| 2002/0177348 | A1 * | 11/2002 | Karamatsu et al. | 439/352 |
| 2011/0034053 | A1 * | 2/2011 | Matsumoto et al. | 439/304 |
| 2011/0171849 | A1 * | 7/2011 | Houir Alami | 439/345 |

FOREIGN PATENT DOCUMENTS

| | | |
|---|---|---|
| EP | 0 185 828 | 7/1986 |

OTHER PUBLICATIONS

English Translation and French Language Version of PCT/ISA/237, Sep. 29, 2009.

* cited by examiner

DEVICE FOR SECURE ELECTRICAL CONNECTION

CROSS-REFERENCE TO RELATED APPLICATIONS

The present application is a U.S. National Stage of International Patent Application No. PCT/FR2009/000579 filed May 19, 2009 which published as WO 2010/007221 on Jan. 21, 2010, and claims priority of French Patent Application No. 0803545 filed Jun. 25, 2008.

BACKGROUND OF THE INVENTION

1. Field of the Invention

The invention relates to a secure electrical connection device, more particularly intended for high power currents.

2. Discussion of Background Information

In a manner known per se, the electrical connection devices comprise an active base and a plug each provided with at least one power contact which are arranged so as to be connected together when the plug and said base are coupled in a connection position.

Connection devices more particularly for high power currents are generally provided with a parallel low power circuit, referred to hereinafter as a pilot circuit, which is provided with pilot contacts arranged to control an apparatus for switching on or switching off the power to the power contact or contacts of the base through the closure and the opening respectively of said circuit.

The aim of this is firstly to ensure that the pilot circuit can only be closed after the connection of the power contacts and in contrast secondly to force the opening of said pilot circuit before the disconnection of the power contacts, such that these two connection and disconnection operations are carried out while the power is off.

It is in fact frequently imperative to bring together or separate the power contacts while the power is off so as in particular to avoid electrical arcs in order to ensure that the power is switched on only when said contacts are in an electrical connection position.

Document EP-0 185 828 describes a connector of this type which additionally comprises an actuator arranged on the base to close and open the pilot circuit, while a device is provided for locking and unlocking the plug in the base in a connection position and comprises matching locking means arranged on the plug and on the base respectively.

However, in this known device for connection by rotation of the power contacts, the actuator which acts directly on the pilot contacts also serves as locking means for the plug and the base.

SUMMARY OF THE INVENTION

The invention proposes an electrical connection device provided, as mentioned previously, with a pilot circuit, an actuator and a device for locking and unlocking the plug in the base but which is notably remarkable in that the locking arrangement for the base separate from the actuator is mounted so as to be mobile and has at least one locking position and one unlocking position, the actuator of the pilot circuit being arranged to secure said locking arrangement for the base in its locking position when said pilot circuit is closed, and to release the locking arrangement when the pilot circuit is open, while the locking arrangement for the base prevents any manoeuvre for coupling the plug and the base or separating these once coupled, when said locking arrangement is secured in its locking position by said actuator.

According to one mode of embodiment, the pilot circuit comprises two pilot contacts fixed on the base and a shunt mounted so as to rotate on the base, while the actuator comprises a arrangement which is locked in rotation with the shunt and has at least one position in which the two pilot contacts close the pilot circuit by contact with the shunt and at least one position in which at least one of the pilot contacts is not in contact with the shunt, the pilot circuit then being open.

In this mode of embodiment, the actuator acts on the shunt and not directly on the pilot contacts which are fixed in contrast to the known prior art described in the document EP-0 185 828 mentioned above.

For example, the locking arrangement for the base comprises a hook which can be moved between a locking position and an unlocked position, and which is locked to an actuating button, while the locking arrangement for the plug comprises a groove designed to receive said hook in the locking position obtained at the end of coupling of the plug and the base, while an elastic arrangement is provided to force the hook towards its locking position.

In this case for example, said hook has an appropriate shape to be forced by a portion of the plug in order to enable it to become lodged by elasticity in the groove of said plug without it being necessary to operate the actuating button.

Advantageously, according to one mode of embodiment provided, as specified previously, with a rotary shunt and a locking arrangement in the form of a hook and a button, the arrangement of the actuator locked in rotation to the shunt is a rotary ring which is provided with a skirt passing under a portion of the actuating button of the hook to secure the latter in a locking position while a notch is provided in said skirt to allow the mobility of said actuating button towards the unlocked position of the hook, this notch being formed in a location on the skirt such that said notch is positioned under said actuating button when the ring is in a position in which the pilot circuit is open.

To secure the device again, according to one mode of embodiment, a locking arrangement for the actuator is also provided to secure the latter in its position in which the pilot circuit is open, while said locking arrangement is arranged so as to be entrained into a releasing position by a portion of the plug when the latter is in a connection position, such that the actuator cannot be maneuvered into its position in which the pilot circuit is closed until after the coupling of the plug in the base and connection of the power contact or contacts of the plug and the base.

For example in this case, the actuator comprises a rotary ring and the locking arrangement for said actuator takes the form of at least one moving rod which is forced by an elastic arrangement towards its locking position in which said rod is introduced into a portion of the actuator to secure said ring in rotation while the rod can be entrained towards its releasing position by a portion of the end of the plug in the course of its coupling with the base. In particular for example, the moving securing rod passes through an opening in the form of an arc of a circle formed in the actuator and has a shoulder designed to fit into a suitable housing of the actuator to secure the latter such that the rod does not impede the rotation of the actuator when the shoulder is outside said housing.

Thus, with the last mode of embodiment mentioned previously, it can be seen that apart from the security features obtained to effect the connection and the disconnection of the power contacts while the power is off, any switching on of the power to the base is prevented as long as the plug is not completely connected.

The invention also provides for an electrical connection device comprising an active base comprising at least one power contact and a plug comprising at least one power contact. The at least one contacts are connectable to each other when the plug and the base are coupled in a connection position. A pilot circuit comprises pilot contacts. An actuator is utilized for switching on or switching off power to the at least one power contact of the base via closure and opening of the pilot circuit. The actuator is movable between at least one locking position and at least one unlocking position. A locking arrangement is utilized for locking and unlocking portions of the plug and the base in the connection position. The electrical connection device comprises the following modes of operation; the actuator is in a position closing the pilot circuit, while the locking arrangement locks the portions of the plug and the base, the actuator is in a position opening the pilot circuit, while the locking arrangement unlocks the portions of the plug and the base, when the locking arrangement is in a locked position, the plug and the base are prevented from being separated, and when the actuator is in the at least one locking position, the locking arrangement is prevented from unlocking the portions of the plug and the base.

The locking arrangement is separate from the actuator. The pilot circuit is closed when a shunt is rotated into contact with the pilot contacts via the actuator. The locking arrangement comprises a hook and a groove and the hook is movable between a locked position and an unlocked position.

The device may further comprise an actuating device configured to allow a user to unlock the hook from the groove. The hook may be elastically engageable with the groove. The actuator may comprises a rotary ring having a skirt configured to pass under a portion of the actuating device. The skirt may comprise a notch which permits movement of the actuating device when positioned under said actuating device and when the rotary ring is in a position in which the pilot circuit is open. The actuator is lockable in a position wherein the pilot circuit is open.

The connection device may further comprise at least one movable rod biased toward a locking position and being configured to lock the actuator by extending into a portion of the actuator so as to prevent rotation. The at least one movable rod may be movable toward an unlocking position during coupling of the plug with the base. The portion of the actuator may comprise an arc-shaped opening formed in the actuator.

Separation of the base and the plug may require two successive manual operations. Separation of the base and plug may require rotation of the actuator and unlocking the locking arrangement.

The invention also provides for an electrical connection device comprising a base comprising at least one power contact and a plug comprising at least one power contact. The at least one contacts are connectable to each other when the plug and the base are coupled in a connection position. A pilot circuit comprises pilot contacts. An actuator is movable between at least one locking position and at least one unlocking position. A locking arrangement is utilized for locking and unlocking portions of the plug and the base in the connection position. The electrical connection device comprises the following modes of operation; the actuator is in a position closing the pilot circuit, while the locking arrangement locks the portions of the plug and the base, the actuator is in a position opening the pilot circuit, while the locking arrangement unlocks the portions of the plug and the base, when the locking arrangement is in a locked position, the plug and the base are prevented from being separated, when the actuator is in the at least one locking position, the locking arrangement is prevented from unlocking the portions of the plug and the base.

Separation of the base and the plug may require two successive manual operations. Separation of the base and plug may require rotation of the actuator and unlocking the locking arrangement.

The invention also provides for an electrical connection device comprising a base comprising at least one power contact and a plug comprising at least one power contact. A pilot circuit comprises pilot contacts. An actuator is movable between at least one locking position and at least one unlocking position and a position closing the pilot circuit and a position opening the pilot circuit. A locking arrangement is utilized for locking and unlocking portions of the plug and the base in the connection position. A device for unlocking the locking arrangement is utilized. When the actuator is in the at least one locking position, the plug and the base are prevented from being separated and the device for unlocking is prevented from unlocking the locking arrangement.

Separation of the base and the plug may require two successive manual operations. Separation of the base and plug may require rotation of the actuator and unlocking the locking arrangement.

BRIEF DESCRIPTION OF THE DRAWINGS

The invention will be clearly understood on reading the description which follows and which refers to the attached drawings in which.

DETAILED DESCRIPTION OF THE INVENTION

Figure 1:
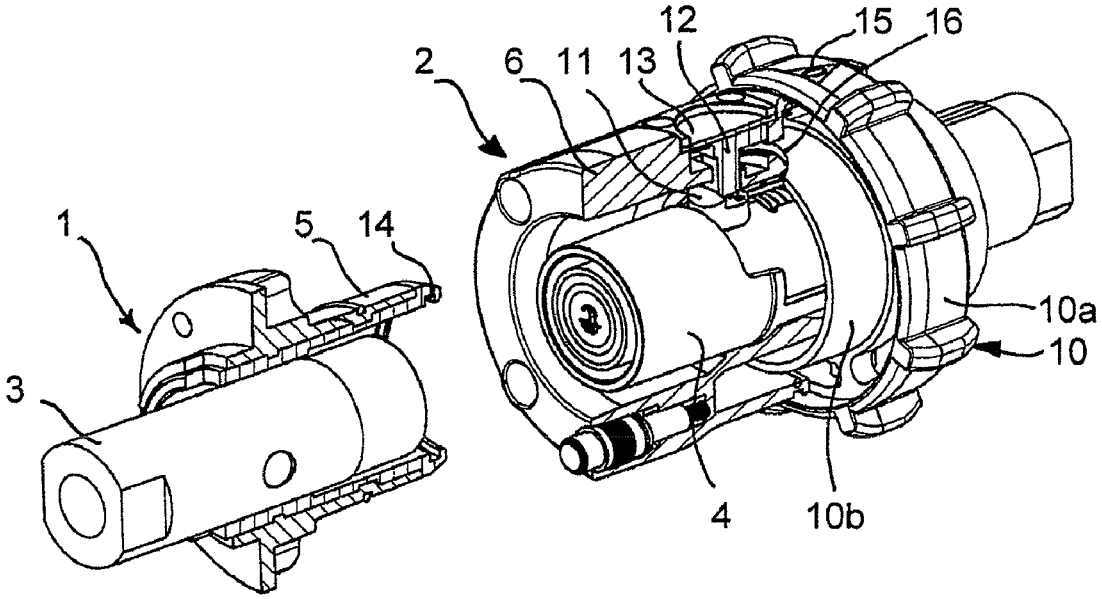
FIG. 1 shows in perspective a base and a plug of a connection device according to one mode of embodiment of the invention, the two elements being shown separately before coupling and connection and with sections of the outer casings of the plug and the base.

The drawings show an electrical connection device formed of a base 1 and a plug 2 each provided with at least one power contact (not visible in the drawings). In the example shown, this is a single pole connection device, i.e. with a single power contact in the plug and the base (in the form for example of a tubular contact for the plug and a flexible blade for the base).

The contacts of the plug and the base are arranged in blocks 3 and 4 respectively of the plug and the base, which are surrounded by an outer casing 5 and 6 respectively.

The power to the power contact or contacts of the base is switched on by an apparatus not shown and which is controlled by a pilot circuit. The low power pilot circuit is designed for example to supply the coil of a contactor which opens or closes the power circuit supplying the base.

Figure 3:
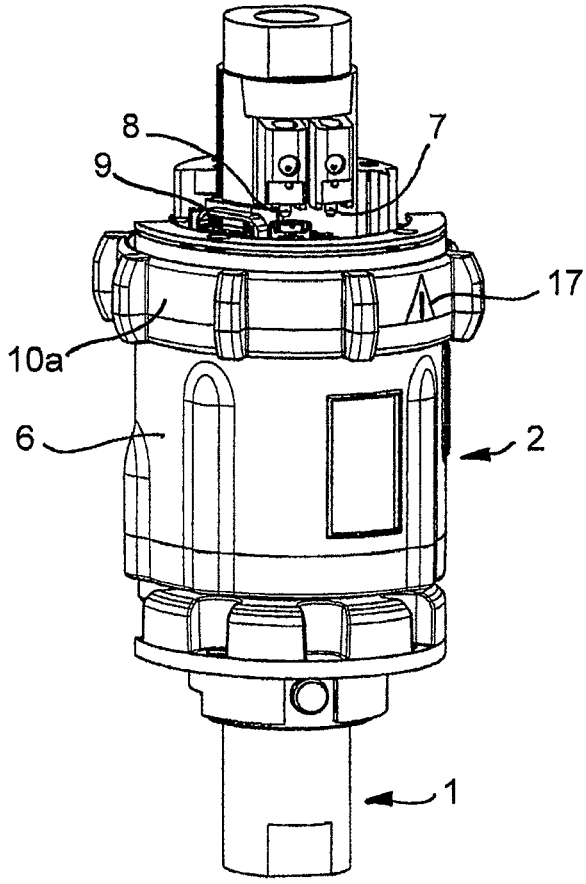
FIG. 3 corresponds to FIG. 2, with another view and without the sections of the casings of the plug and the base.
Figure 5:
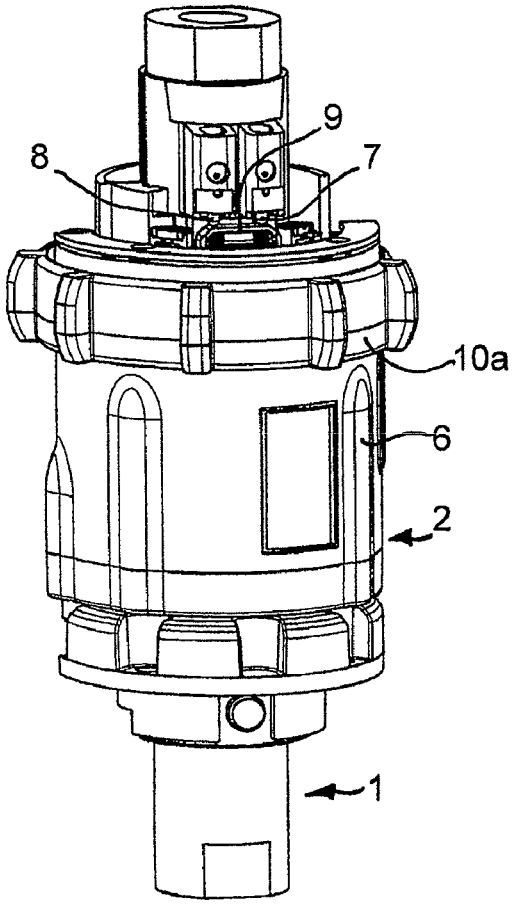
FIG. 5 corresponds to FIG. 4, with another view and without the sections of the casings of the plug and the base.

In the mode of embodiment shown, the pilot circuit is constituted here by two pilot contacts 7 and 8 arranged on the base and which can be seen in FIGS. 3 and 5.

The pilot contacts 7 and 8 form a circuit which can be closed by a shunt 9 in the form here of a simple strip. In FIG. 3, it can be seen that the pilot circuit is open, as the shunt 9 is not connecting the pilot contacts electrically, while in the position in FIG. 5 the pilot circuit is closed by the shunt 9, the actuation of the shunt being controlled by an actuator 10 which will be discussed in greater detail hereinafter.

Figure 2:
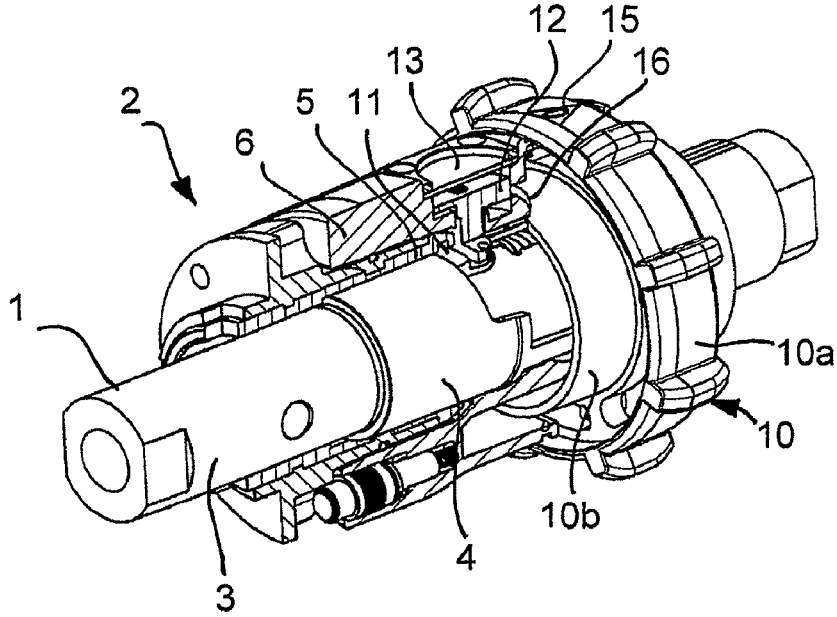
FIG. 2 shows the base and the plug in FIG. 1 towards the end of their coupling in a connection position.

The coupling of the plug in the base can be carried out by various manoeuvres which comprise here at least one movement of translation to pass from the position in FIG. 1 to the position in FIG. 2.

The plug and the base comprise matching arrangement for locking in a connection position which here take the form of a hook 11 (FIGS. 1, 2, 4 and 6) arranged in the base and which is forced by an elastic arrangement (not visible in the drawings) towards its locking position, said elastic arrangement being for example a spring disposed under the hook.

The hook 11 can also be actuated by a button 12 locked to said hook towards its unlocking position against said elastic arrangement mentioned previously.

Moreover in this example the button 12 is insulated from the exterior by a flexible membrane 13 (FIGS. 1, 2, 4, 6).

The matching locking arrangement arranged on the plug here takes the form of a groove 14 formed at the end of the casing 5 of said plug.

When the plug is introduced into the casing 6 of the base, the front end of the casing 5 of the plug comes to bear on the hook 11 possibly provided for that purpose with an oblique portion forming a ramp such that said hook 11 engages entraining with it the button 12 as shown in FIG. 2 (however, it would also be possible to press the button 12 for this operation).

Figure 4:
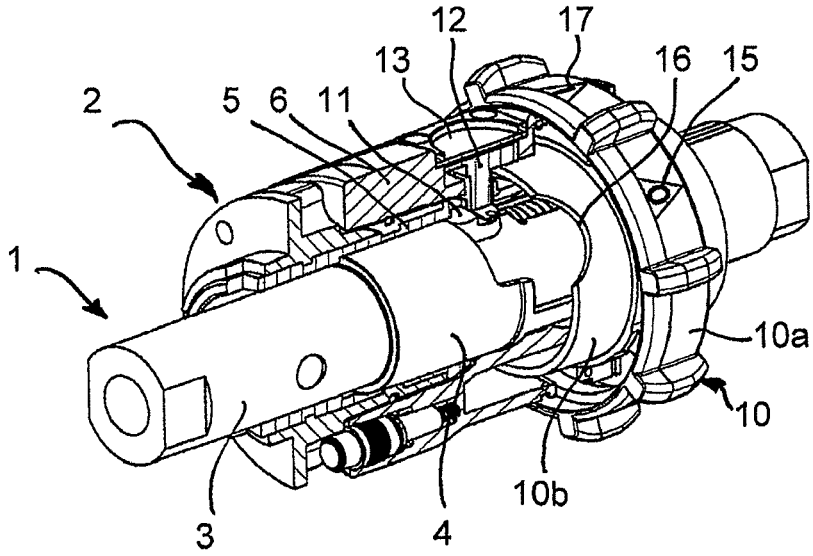
FIG. 4 corresponds to FIG. 2 after total coupling, the actuator having been maneuvered into a position in which the pilot circuit is closed.

It can be seen that at the end of coupling, in the position in which the power contacts of the base and the plug are connected together, the hook 11 moves up into the groove 14, so locking the plug in the base as shown in FIG. 4.

The unlocking can then only be carried out by applying a pressure to the button 12.

The actuator 10 comprises a rotary actuating ring 10*a* and a skirt 10*b* locked to or forming a part of said ring which extends into the casing 6 of the base under a portion of the button 12, as shown clearly in FIGS. 1, 2, 4 and 6.

The ring 10*a* of the actuator is locked to the shunt 9 such that in the angular position of the latter shown in FIGS. 1, 2, 3 and 6, the pilot circuit 7, 8 is open as explained previously. To mark this position, a mark 15, for example the character "O", marked on the ring 10*a* finds itself facing the button 12, as shown clearly in FIGS. 1 and 2.

The skirt 10*b* of the actuator 10 exhibits a notch 16, here in the form of a half circle, disposed in the position in FIGS. 1, 2, 3 and 6 just under the button 12, thus allowing freedom of movement to said button 12 in this position.

If the ring 10*a* of the actuator 10 is turned to adopt the position in FIGS. 4 and 5 so as to bring here a mark 17, for example the character "I" marked on said ring, just facing the button 12, the shunt 9 (FIG. 5) closes the pilot circuit 7, 8.

It can then be seen that in this position (FIGS. 4 and 5), the skirt 10*b* secures the button 12 which cannot be moved towards the unlocking position of the plug and the base.

Figure 7:
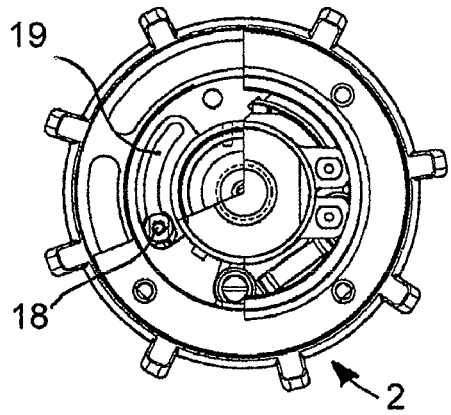
FIG. 7 is an end view of the rear face of the base with a portion in section to show the interior.
Figure 6:
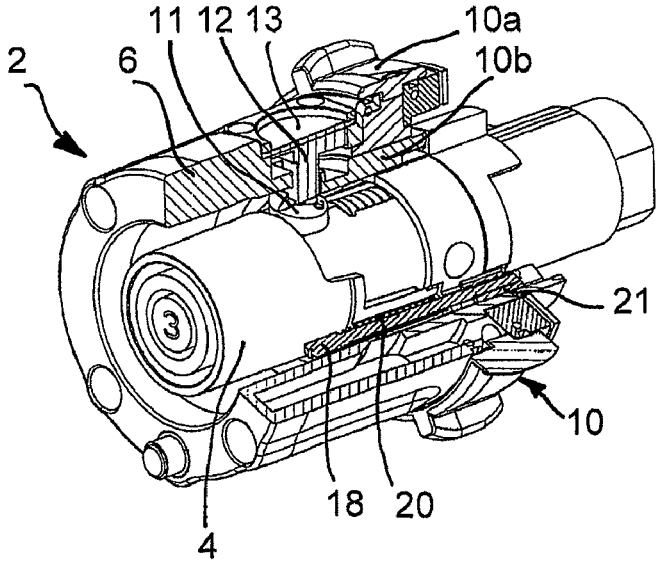
FIG. 6 shows the base in FIG. 1 in the same position but with another plane for the section of the outer casing and in addition with a section of the actuator.

Moreover, as shown clearly in FIGS. 6 and 7, a rod 18 is arranged in the base and passes through an opening 19 in the form of an arc of a circle (FIG. 7) formed in the actuator 10.

The rod 18 is forced by a spring 20 (FIG. 6) into a locking position in which a shoulder 21 prevents the rotation of the ring 10*a* by engaging in an appropriate housing of the actuator.

This rod 18 can be forced by the end section of the casing 5 of the plug against the spring 20 in order to unlock and allow the rotation of the ring 10*a*.

Following this description, the invention is easy to understand.

The plug 1 and the base 2 of the device initially appear in the position in FIGS. 1, 2, 3, 6 and 7.

In this position, the pilot circuit 7, 8 is open and the ring 10*a* is prevented from rotating by the rod 18 (FIG. 6) such that the power cannot be switched to the base since said pilot circuit can only be closed after having unlocked the ring 10*a* of the actuator by way of the plug 1.

However, this locking of the ring 10*a* is an additional security feature, as will be explained hereinafter.

After the coupling of the plug and the base (FIG. 2) until the two elements are locked by way of the hook 11 which engages in the groove 14 of the plug, it will be understood that the power contacts are connected together but that as the pilot circuit is open, the power is not switched on to the base.

At the end of the coupling operation, the rod 18 (FIG. 6) forced by the casing 5 of the plug, releases the ring 10*a* which can then be turned to close the pilot circuit as mentioned previously (FIGS. 4 and 5) and thus switch on the power to the base.

It will then be understood that the power contacts are connected together first before the power is switched on to the base.

In this position in which the power contacts are connected, with the power also switched on to the base (FIGS. 4 and 5), it can be seen that the skirt 10*b* of the actuator located under the button 12 prevents its actuation and thus any separation of the plug and the base due to the fact that the hook 11 cannot be disengaged from the groove 14 of the plug.

It is thus impossible to disconnect the plug and the base while the power is on, i.e. with the power switched on to the base.

To unlock the plug and the base it is firstly necessary to turn the ring 10*a* so that it returns to the position shown in FIGS. 1, 2, 3 and 6, the position in which the pilot circuit is open (and the power to the base is switched off) while the notch 16 allows the operation of the button 12 and thus the unlocking of the base and the plug.

Thus, the separation of the base and the plug requires two successive manual operations, namely: rotation of the ring of the actuator and operation of the locking button.

In the absence of the locking of the actuator 10 by the rod 18, it will be understood however that if the power is switched on to the base after rotation of the ring 10*a*, the skirt 10*b* prevents any operation of the button 12 and the hook 11 which remain in the locking position preventing any coupling of the plug and the base and hence any connection of the power contacts while the power is on.

The rod 18 which prevents the power being switched on to the base when the plug is not introduced into the base, also makes it possible to ensure that the power can only be switched on to the base if the plug is in the position in which the power contacts are completely connected.

Thus, the device according to the invention makes it impossible to connect and disconnect the power contacts when the power is switched on to the base.

The invention claimed is:

1. An electrical connection device comprising:

an active base comprising at least one power contact;

a plug comprising at least one power contact;

said at least one contacts being connectable to each other when the plug and the base are coupled in a connection position;

a pilot circuit comprising pilot contacts;

an actuator for switching on or switching off power to the at least one power contact of the base via closure and opening of the pilot circuit;

the actuator being movable between at least one locking position and at least one unlocking position; and a locking arrangement for locking and unlocking portions of the plug and the base in the connection position, wherein the electrical connection device comprises the following modes of operation:

the actuator is in a position closing the pilot circuit, while the locking arrangement locks the portions of the plug and the base;

the actuator is in a position opening the pilot circuit, while the locking arrangement unlocks the portions of the plug and the base;

when the locking arrangement is in a locked position, the plug and the base are prevented from being separated; and when the actuator is in the at least one locking position, the locking arrangement is prevented from unlocking the portions of the plug and the base.

2. The connection device of claim 1, wherein the locking arrangement is separate from the actuator.

3. The connection device of claim 1, wherein the pilot circuit is closed when a shunt is rotated into contact with the pilot contacts.

4. The connection device of claim 1, wherein the locking arrangement comprises a hook and a groove and the hook is movable between a locked position and an unlocked position.

5. The connection device of claim 4, further comprising an actuating device configured to allow a user to unlock the hook from the groove.

6. The connection device of claim 5, wherein the actuator comprises a rotary ring having a skirt configured to pass under a portion of the actuating device.

7. The connection device of claim 6, wherein the skirt comprises a notch which permits movement of the actuating device when positioned under said actuating device and when the rotary ring is in a position in which the pilot circuit is open.

8. The connection device of claim 4, wherein the hook is elastically engageable with the groove.

9. The connection device of claim 1, wherein the actuator is lockable in a position wherein the pilot circuit is open.

10. The connection device of claim 1, further comprising at least one movable rod biased toward a locking position and being configured to lock the actuator by extending into a portion of the actuator so as to prevent rotation.

11. The connection device of claim 10, wherein the at least one movable rod is movable toward an unlocking position during coupling of the plug with the base.

12. The connection device of claim 10, wherein the portion of the actuator comprises an arc-shaped opening formed in the actuator.

13. The connection device of claim 1, wherein separation of the base and the plug requires two successive manual operations.

14. The connection device of claim 1, wherein separation of the base and plug requires rotation of the actuator and unlocking the locking arrangement.

15. An electrical connection device comprising:

a base comprising at least one power contact;

a plug comprising at least one power contact;

said at least one contacts being connectable to each other when the plug and the base are coupled in a connection position;

a pilot circuit comprising pilot contacts;

an actuator being movable between at least one locking position and at least one unlocking position; and a locking arrangement for locking and unlocking portions of the plug and the base in the connection position, wherein the electrical connection device comprises the following modes of operation:

the actuator is in a position closing the pilot circuit, while the locking arrangement locks the portions of the plug and the base;

the actuator is in a position opening the pilot circuit, while the locking arrangement unlocks the portions of the plug and the base;

when the locking arrangement is in a locked position, the plug and the base are prevented from being separated;

when the actuator is in the at least one locking position, the locking arrangement is prevented from unlocking the portions of the plug and the base.

16. The connection device of claim 15, wherein separation of the base and the plug requires two successive manual operations.

17. The connection device of claim 15, wherein separation of the base and plug requires rotation of the actuator and unlocking the locking arrangement.

18. An electrical connection device comprising:

a base comprising at least one power contact;

a plug comprising at least one power contact;

a pilot circuit comprising pilot contacts;

an actuator being movable between:

at least one locking position and at least one unlocking position; and a position closing the pilot circuit and a position opening the pilot circuit;

a locking arrangement for locking and unlocking portions of the plug and the base in the connection position; and a device for unlocking the locking arrangement, wherein, when the actuator is in the at least one locking position, the plug and the base are prevented from being separated and the device for unlocking is prevented from unlocking the locking arrangement.

19. The connection device of claim 18, wherein separation of the base and the plug requires two successive manual operations.

20. The connection device of claim 18, wherein separation of the base and plug requires rotation of the actuator and unlocking the locking arrangement.

* * * * *